US006659852B1

(12) United States Patent
Wettstein et al.

(10) Patent No.: US 6,659,852 B1
(45) Date of Patent: Dec. 9, 2003

(54) SANDING BLOCK

(76) Inventors: Brad R. Wettstein, 1158 Hubbard Ave., Escondido, CA (US) 92027; James Hassler, 1131 Sheridan Ave., Escondido, CA (US) 92027; Steve Dodds, 4020 Royal Dr., Carlsbad, CA (US) 92008

( * ) Notice: Subject to any disclaimer, the term of this patent is extended or adjusted under 35 U.S.C. 154(b) by 0 days.

(21) Appl. No.: 10/212,916

(22) Filed: Aug. 5, 2002

(51) Int. Cl.[7] ..... B23F 21/03

(52) U.S. Cl. ..... 451/557; 451/344; 451/357; 451/521; 451/523; 451/524; 451/525; 451/526

(58) Field of Search ..... 451/344, 359, 451/521, 523, 524, 525, 526

(56) References Cited

U.S. PATENT DOCUMENTS

| | | | | |
|---|---|---|---|---|
| 2,711,059 A | * | 6/1955 | Ames | 451/522 |
| 4,885,876 A | * | 12/1989 | Henke | 451/503 |
| 5,016,402 A | | 5/1991 | Reiter | |
| 5,309,681 A | | 5/1994 | Cheney et al. | |
| 5,323,507 A | * | 6/1994 | Tosato | 15/231 |
| 5,527,212 A | | 6/1996 | Bowen et al. | |
| 5,545,080 A | | 8/1996 | Clowers et al. | |
| 5,624,305 A | | 4/1997 | Brown | |
| 5,895,316 A | | 4/1999 | Williams | |
| 5,941,765 A | | 8/1999 | Taylor | |
| 6,053,805 A | | 4/2000 | Sanchez | |
| 6,325,708 B1 | * | 12/2001 | Miles | 451/354 |

* cited by examiner

*Primary Examiner*—Joseph J. Hail, III
*Assistant Examiner*—Shantese McDonald
(74) *Attorney, Agent, or Firm*—Donn K. Harms

(57) ABSTRACT

An improved sanding block for sanding high and extended surfaces configured for use in combination with an attached pole. The sanding block is round in shape and is rotationally mounted on a pole mount that interfaces between the sanding block and the pole which attaches to a rotatable hub of the pole mount. This allows the sanding block to rotate during use and the pole to be rotated to different angles in relation to the flat working surface of the sanding block. Adjacent surface marring is prevented by the rotation of the sanding block upon contact of a side edge with such an adjacent surface. Optionally the pole mount can be locked to prevent rotation if desired and a barrel can provide an interface between the pole and the pole mount. This barrel can be straight, angled, or adjustable for angle, in the different preferred embodiments.

17 Claims, 2 Drawing Sheets

SANDING BLOCK

BACKGROUND OF THE INVENTION

1. Field of the Invention

The present invention relates to a sanding block for surface preparation. More particularly it relates to an improved sanding block which is round and rotatably mounted on a swiveling attachment member which is cooperatively engageable with the distal end of an elongated pole.

The device in the current best mode, also features an improved attachment of the handle to the rear surface of the sanding block which uses an angled or adjustable barrel providing for an angled engagement of the pole with the attachment member. This unique attachment provides for the user to easily sand using the extension handle at one or a plurality of angles of the handle to its attachment to the rear surface of the sanding block. Using this angled means of attachment provides the ability of sanding a surface at virtually any angle including a declining angle that allows for sanding of a horizontal surface, such as a ceiling, from underneath a ledge. Still further, the provision of a round rotatable sanding block which rotates and has smooth side edges alleviates a constant and vexing problem when sanding abutting surfaces such as a ceiling and adjoining wall. Using this unique arrangement allows for the side edge of the sanding block surface to rotate upon the adjoining surface when contacting it thereby alleviating scuffs and dings which would be caused using conventional rectangular stationary sanding blocks.

2. Prior Art

Surface preparation during construction has been a requirement since the dawn of construction. In modern construction the use of flat surfaces such as wood and especially drywall, for walls and ceilings, has necessitated the need for finished sanding prior to final surfacing with paint or plaster.

During construction using drywall, conventionally large rectangular pieces of drywall material are attached to properly spaced wall and ceiling studs. This attachment by screws or nails is inherently damaging to the drywall material. Additionally, where the individual rectangles of drywall intersect in their attachment to walls and ceilings, there exists naturally a seam or void between the two adjoining drywall pieces.

The damage from nails and screws to the surface and the voids between the individual drywall pieces requires the use of a finishing material commonly known as joint compound and joint tape. A mixture of cementacious paste formulated to the task is applied over the dents from nails, screws, and the voids, along with a tape, to act as a bond between the different drywall surfaces in relation to each other. In applying this tape and joint compound to the various surfaces needing it after installation of drywall sheets, there is created as a natural outcome a degree of unevenness between adjoining surfaces as well as over indentations covered with compound alone.

Additionally, some surfaces need to be scored to accept the next surfacing to cover the underlying surface in order to properly adhere. This scoring and surfacing of underlying surfaces is also conventionally accomplished by sanding using sandpaper or sandpaper attached to holding devices.

Such sandpaper holding devices are conventionally known as sanding blocks and have not really improved over time. Generally, such devices include a pair of clips biased against the rearward surface which hold an elongated sheet of sandpaper which is stretched over the front surface and placed in biased engagement between the rear surface and the clip. To install the first piece of sand paper or replace an exhausted piece of sandpaper, the user must hold the sanding block in their hand and apply pressure to the biased clip to open it and disengage the sandpaper in-between the clip and the rear surface of the sanding block. Installation of sandpaper is of course done in reverse order.

Such conventional sanding blocks have inherent problems which cause excessive time usage due to fumbling during installation of the sandpaper. Further, the use of such a biased clip device to hold the sand paper on the sanding block impedes the angles at which the elongated handle attached to the rear surface of the sanding block may achieve. Still further, such conventional sanding blocks, because of their poor engagement between the sanding block and the attached pole or handle used to move them, are inherently prone to flipping over, wherein the biased clips and handle attachment can severely mar or dent the surface which is being finished thereby causing damage, lost time due to resurfacing requirements, as well as the potential need to replace the surface so damaged when working with expensive woods and exotic surface materials which cannot be covered over with paint and other surface materials. Additionally, conventional sanding blocks have an inherent tendency to mar and scar the adjoining surfaces when the sanding block reaches the intersection of such surfaces. Consequently, when sanding a ceiling, the adjoining wall surfaces frequently suffer damage from the sanding block upon the wall surfaces and vice versa.

U.S. Pat. No. 6,053,805 (Sanchez) teaches a dust free sanding device for wallboards and drywall that has a hollow handle attached to the rear surface with a knuckle. However, Sanchez uses screw mounts which attach the sandpaper over the rear side which impede the angles at which the handle may reach in relation to the rear surface. Additionally, Sanchez lacks the rotating attachment of the handle to the sanding block to aid in the prevention of sanding block flipover and adjacent surface marring, and teaches an expensive and complicated sealed engagement of the handle.

U.S. Pat. No. 6,325,708 (Miles) discloses a device for sanding corners; however, Miles teaches the use of raised shoulder to attach the handle to the rear surface which will easily jam with the gap in the handle end causing the handle to stick on the shoulders at the extreme angles encountered during surfacing walls and ceilings. Miles is also not intended to surface flat surface areas but only in corners.

U.S. Pat. No. 5,895,316 (Williams) discloses a dry wall corner sander for use with a handle; however, Williams is only designed for sanding a curved surface and by design is intended to rock during use and would be extremely prone to flip over on a flat surface due to the high mounting point of the handle to the rear.

U.S. Pat. No. 5,624,305 (Brown) teaches a pole mounted sander for use in combination with a vacuum. Brown, while disclosing a mount for the sanding block on the end of a pole, obstructs the pole from achieving a descending angle toward the leading edges by using mechanical mounts for the sandpaper also impedes the sideways transition of the pole due to the required vacuum accommodating mount of the pole to the back side of the sanding block. Brown would also tend to mar adjacent surfaces in corners and along edges where walls meet ceilings.

As such, there is a pressing need for a sanding block which will mount to the end of an elongated pole and allow for the easy attachment of a variety of sandpapers to the sanding surface. Such a device should inherently be stable and resist flipping over during. Such a device should also minimize the characteristics that cause flipping over of the sanding block through the use of curved edges. Such a device would be further enhanced by the provision of a mounting system for the pole to the back of the sanding block which allows for the pole to achieve one or a plurality of angles and even descending angle in relation to the surface of the sanding block to allow for the user to sand vertical surfaces and under ledges. Finally, such a device should prevent the marring of adjacent surfaces during sanding through the use of rotating edges.

SUMMARY OF THE INVENTION

Applicants' device is an improved sanding block which features a number of embodiments and design characteristics which combine to substantially increase the utility of such devices and which may also be used individually to enhance the utility of conventional pole mounted sanding devices.

All preferred embodiments feature a pole mount attached to the rear surface of the sanding block opposite the working surface where the sandpaper attaches. Such attachment would be cooperatively engageable with conventional poles used for sanding.

This rear attachment provides for rotation of the sanding block in a circular fashion about an axis and rotation of the pole in a circular fashion in relation to the rear surface of the sanding block. Additionally, the device features a defined clear path for the pole or mating attachments, from the leading edge to the opposite edge. The clear path assures that the side surface of any pole interface or the pole itself, when attached to the device, does not encounter any obstructions projecting from the rear surface of the sanding block which would cause the pole to stick during use impeding the sanding process and generally can cause the sanding block to flip over and impart dents and scratches to the surface being finished.

The elimination of any projecting parts from the leading edges of the rear side of the sanding block is enabled by using a means of attachment of the sandpaper to the working surface that does not require wrapping the sandpaper over the side edges of the sanding block and securing it on the back. This is best provided by a means of attachment of the sandpaper to the working surface in the form of cooperatively engageable hook and loop fabric which in the current best mode would feature the permanent mount of either the hook or loop fabric to the working surface which would cooperatively engage with the opposite material affixed to the rear of the sandpaper. This makes it especially easy for the user to replace or change the sandpaper being used on the front or working surface as needed by simply gripping an edge of the sandpaper and separating the cooperatively engaged hook and loop fabric. Another means for removable attachment of the sandpaper to the working surface would be through the use of adhesive on the sandpaper that is designed to securely hold the sandpaper to the working surface with good adhesion characteristics to prevent removal during lateral translation of the sandpaper during use, but, easy removal through vertical pulling of the sandpaper off the working surface. Such adhesives are conventionally available for other "peel and stick" applications and would work well in this case also.

The circular shape of the sanding block functions much better than conventional rectangular sanding blocks, especially with the unique pole mounting apparatus affixed to the back side. The unique double rotating attachment allows the pole to reach a plurality of angles between the leading edge and opposite edge and even descending angles in relation to the rear surface of the sanding block, as well as to prevent any sticking of the pole or pole mount to any parts projecting upward from the rear surface of the sanding block.

When used with another preferred embodiment in a round shape, the rounded edge of the sanding block limits the amount of edge surface of the sanding block that can frictionally engage with the surface being sanded during use due to the curve of the circle. In use this aids in preventing flip over since it is especially hard to dig in an edge of the sanding block accidentally because the edge surface is curved and limited in length. Further, a rounded edge allows for easy use in any direction with equal force since the side edges in the direction of use are always the same length due to the curve of the circle as opposed to the unequal force needed with the rectangular shape since it has a long edge and short edge which require different amounts of force when the sanding block is moved during use in one direction or the other. The provision of a round sanding block which is rotationally mounted to its engagement with the pole offers the additional benefit of prevention of marring of adjacent surfaces.

It is an object of this invention to provide a pole mountable sanding block which minimizes the frictional engagement of the pole or pole mount with the rear surface of the sanding block or projections therefrom to thereby avoid sticking between the pole and the sanding block during use.

Another objective of this invention is to provide such a pole mountable sanding block which maintains a clear path between the edges of the sanding block on the rear surface to prevent sticking of the pole on projections from the rear surface and to allow for the pole to achieve a descending angle in relation to the rear surface to enhance use.

An additional objective of this invention is to provide a means to attach the sandpaper to the working surface that minimizes the dexterity required of the user to attach the sandpaper and eliminates any mounting parts from the rear surface of the sanding block.

A still further object of this invention is the provision of a swivel attachment of the pole to the rear of the sanding block to allow for one or a plurality of angles of the pole in relation to the rear surface of the sanding block.

Another object of this invention is the provision of a round rotatably mounted sanding block which prevents marring of surfaces intersecting and adjacent to the surface being sanded by rolling thereon.

Further objectives of this invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
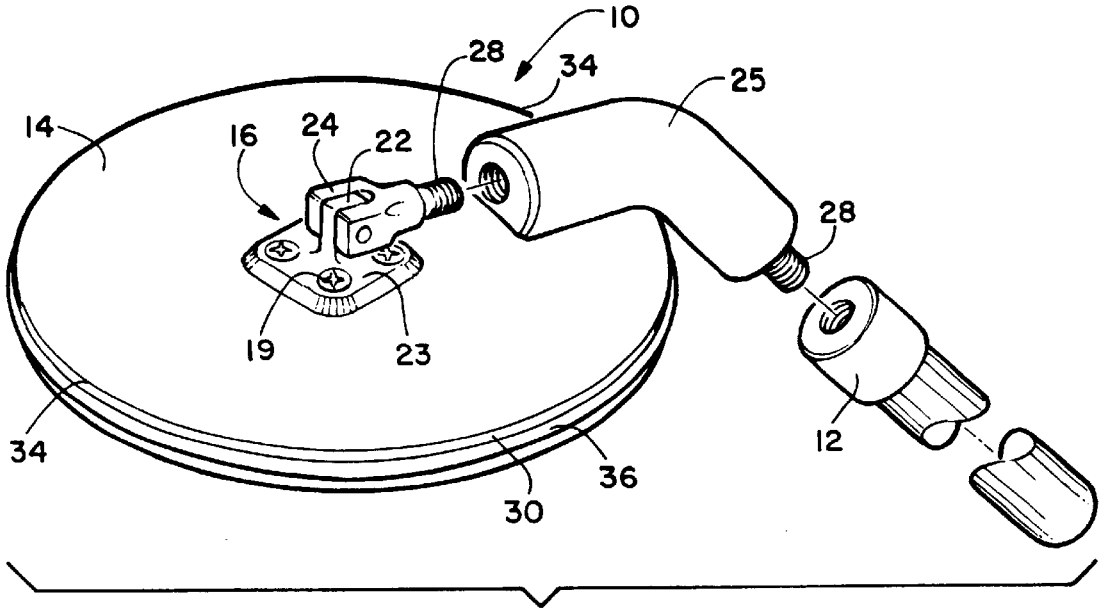
FIG. 1 is a perspective view of the disclosed device depicting a round shaped sanding block embodiment and showing the rear surface attachment to a pole mount.
Figure 2:
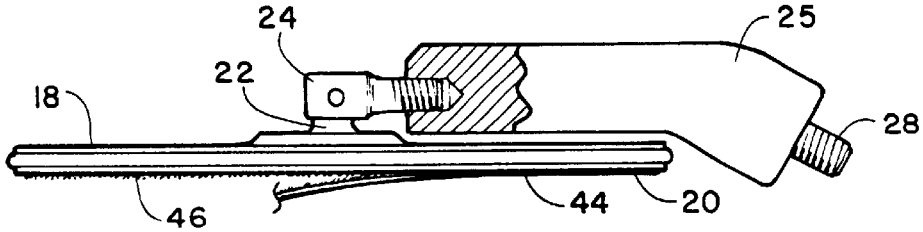
FIG. 2 is a side view showing of the disclosed device with the swivel mount and curved barrel attachment on the rear surface thereof providing a negative angled attachment to a pole.
Figure 3:
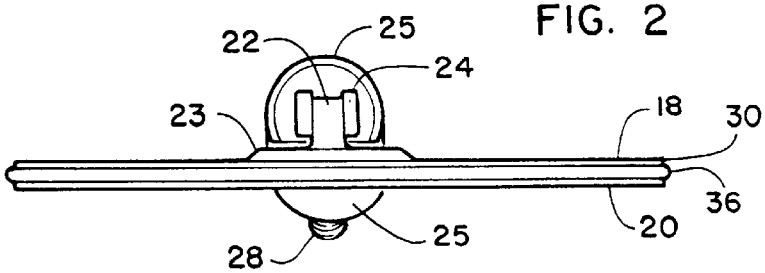
FIG. 3 is a side view along line 3 of FIG. 2.
Figure 4:
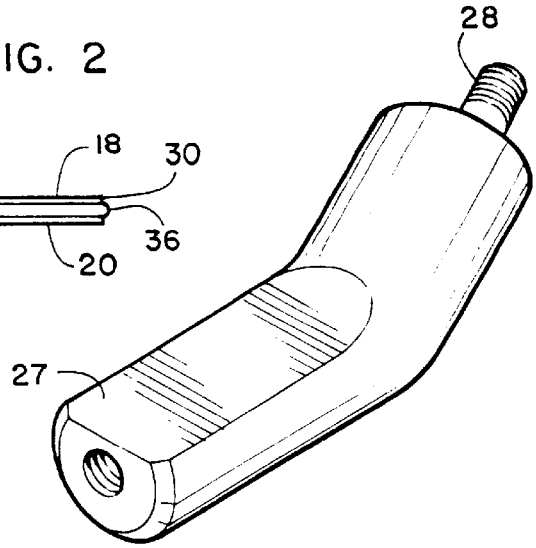
FIG. 4 is a perspective view of the adapter attachment to facilitate engagement of a pole used in combination herewith with the device.

Referring now to the drawings FIGS. 1–5 disclose the preferred embodiments of the herein disclosed sanding block device 10 for attachment to, and use in combination with, an attachable pole 12 shown in phantom line.

In a first preferred embodiment as shown in FIG. 1 a sanding block 14 is round in shape. As used in this embodiment and all preferred embodiments herein, a pole mount 16 is affixed to the rear surface 18 opposite the working surface 20 of the generally planer sanding block 14.

The pole mount 16, in the current best mode, features an axle 22 rotationally engaged with a base 23 which is engaged with means of attachment to the rear surface 18 of the sanding block 14 which in this case is screws 19. The axle 22 has a center axis which is substantially normal to the rear surface 18 of the sanding block 14 however it could also be angled and such is anticipated.

Rotationally engaged with the axle 22 is a hub 24. The hub 24 thus engaged at a first end, has an attachment end that provides a means for cooperative engagement with a barrel 25 which is curved at a determined angle, or with the pole 12, should the pole itself be angled and so attached, or should no angled attachment be desired. Currently this means of attachment is depicted as threads 28. However other means for cooperative engagement with a pole 12 or with the barrel 25 could be used and are anticipated. The threads 28 and their cooperative engagement with the barrel 25 also provide a means for lateral translation of the pole engagement end of the barrel 25 toward and away from the axle 22, to provide some adjustment of the distance between the attachment at the base and the end of the pole 12.

Figure 5:
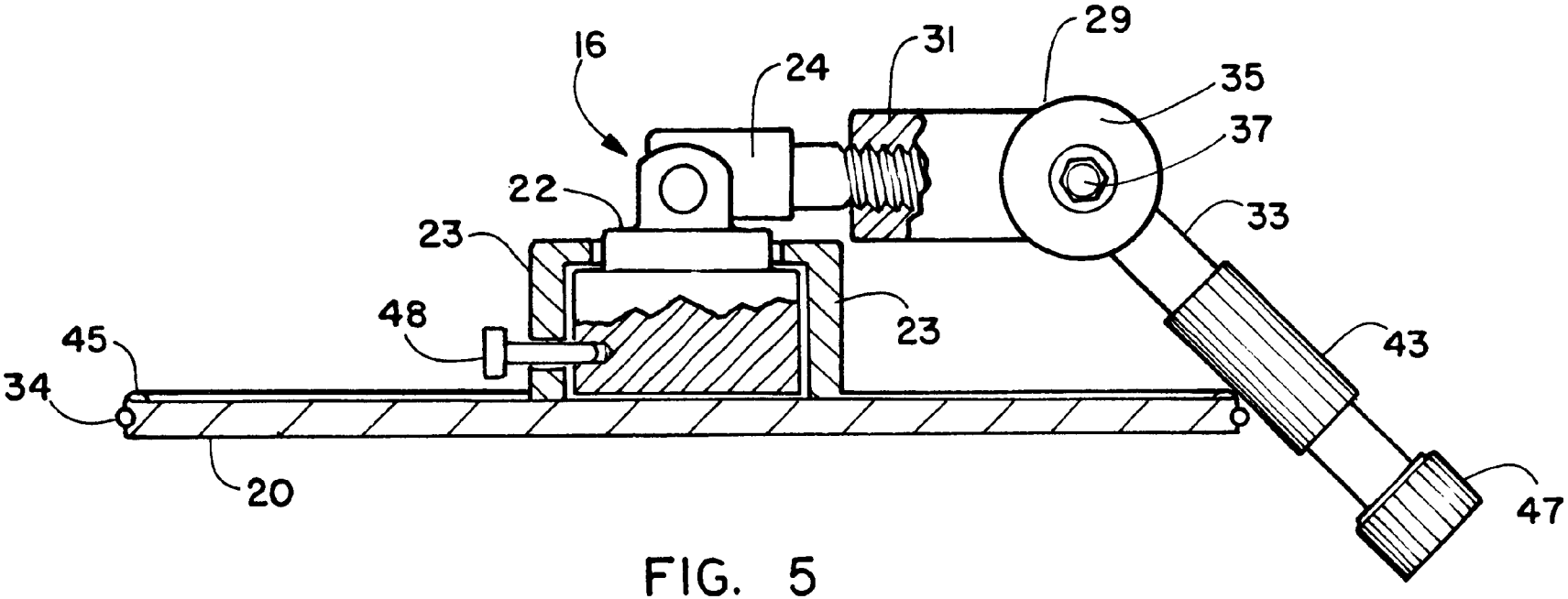
FIG. 5 is a side view of another preferred embodiment of the device showing an adjustable interface for changing the angle of attachment of a pole to the device.

By mounting the axle 22 rotationally engaged with the sanding block 14 and the hub 24 rotationally with the axle 22 the communicating pole 12 can swivel in all directions during use in sanding a surface. The barrel 25 has an exterior surface area 27 formed to be substantially parallel with the rear surface 18 of the sanding block 14 when the pole is to be used at a decreasing angle 22 to thereby provide a means to minimize frictional engagement between the barrel 25 and pole 12 and the rear surface 18. Or, as shown in FIG. 5, the adjustable barrel 29 would engage an edge surface of the sanding block 14 to provide such means to minimize frictional engagement. Prevention of sticking or frictional engagement of the pole 12 with the rear surface 18 of the sanding block 14 or abutments mounted thereon is further prevented by the provision of a defined clear path for the pole 12 extending from the leading edge to the rear edge. The clear path assures that the side of the pole 12 or the barrel 25 attached to the device 10 does not encounter any obstructions projecting from the rear surface 18 of the sanding block 14 which would cause the pole 12 to stick during use. The clear path for the pole 12 and barrel 25 on the rear surface 18 is accomplished by the elimination of any projecting parts from the rear surface 14 other than the axle 22 with the pole communicates. This would ensure that the pole 12 and/or barrel 25 could rotate 360 degrees around the center of sanding block 14 about the axle 22, without an impediment.

The sandpaper 44 used in combination herewith would be affixed to the working surface 20 using a means of attachment of the sandpaper to the working surface which does not require wrapping the sandpaper over the side edges 34. This is best provided by a means of attachment of the sandpaper to the working surface in the form of cooperatively engageable hook and loop fabric 46 which in the current best mode would feature the permanent mount of either the hook or loop fabric to the working surface 20 which would cooperatively engage with the opposite material affixed to the rear surface of the sandpaper 44. Such a means of attachment of the sandpaper 44 to the working surface 20 makes it especially easy for the user to replace or change the sandpaper being used on the front or working surface as needed by simply gripping an edge of the sandpaper and separating the cooperatively engaged hook and loop fabric. Another means for removable attachment of the sandpaper 44 to the working surface 20 would be through the use of adhesive on the sandpaper 44 that is designed to securely hold the sandpaper 44 to the working surface 20 but is easily removed by vertical pulling force on the sandpaper 44.

As noted, the device 10 provides a means to prevent marring of adjoining surfaces to that being sanded in the form of the sanding block 14 being round and essentially rolling upon such adjoining surfaces when encountered. Such prevention is additionally improved by the addition of a very smooth side edge 30 and the addition of a bumper 36 attached to the side edge 30. The bumper 36 is best made from a resilient material such as plastic or rubber to provide both shock absorption and better engagement of the side edge 30 with an adjoining surface to encourage the sanding block 14 to rotate thereon and further avoid any marring or scratching of that surface.

An additional preferred embodiment of the device 10 would feature a pole mount 16 that would provide an adjustable barrel 29. In this embodiment as best shown in FIG. 5, the adjustable barrel 29 would have a first member 31 configured for engagement with the hub 24 and a second member 33 joined to the first member by a knuckle 35. The knuckle 35 as shown would allow a means of adjustment of the angle of the knuckle by adjustment of the angle of the second member 33 in relation to the rear surface 18 such that the user could adjust the angle to the desired amount. A screw 37 or other conventional means for securing the angle can be used to allow for adjusting and setting the angle as desired. A sleeve 43 about the exterior of the second member 33 would provide the means to minimize frictional engagement between the adjustable barrel 29 and the rear surface 18. This sleeve 43 would be especially effective in combination with a raised race 45 at the edge 34 of the rears surface 18. Of course the race 45 would also work well in combination with the components of FIG. 1 especially if a direct mount to a pole 12 is used with the pole 12 bent to the angle desired wherein the race 45 would encounter the side surface of the pole 12 and provide the means to minimize frictional engagement between the pole and the rear surface or between the barrel 25 and rear surface 18.

Also shown in FIG. 5 is an axle 22 engaged in a raised base 23. This embodiment with the raised base 23 would allow for the provision of a stop 44 which would provide a selectable means lock the axle 22 and to prevent rotation of the axle and thereby allow the axle 22 to be fixed in position should such be desired. Of course this embodiment could be used with the barrel 25 of a fixed dimension or with a direct pole attachment and still provide for rotation of the sanding block 18 during use but also provide for ceasing of such rotation if desired. Additionally shown is a female means engagement 47 providing another for attachment to a pole 12 which could be used for poles 12 not having a threaded end.

While all of the fundamental characteristics and features of the sanding block with swivel attachment have been described herein, with reference to particular embodiments thereof, a latitude of modifications, various changes and substitutions are intended in the foregoing disclosure and it will be apparent that in some instances, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. An improved sanding block for attachment to a pole and sandpaper used in combination herewith comprising:

a sanding block having a rear surface terminating at a rear edge, and a substantially flat working surface, a side edge communicating between said rear surface and said working surface;

said sanding block being substantially round in shape;

means of attachment of sandpaper to said working surface;

a pole mount having an axle and a base, said pole mount rotationally engaged with said rear surface of said sanding block;

a hub, said hub having a first end rotationally engaged with said axle, said hub having a second end;

means for attachment of said second end of said hub to a pole used in combination herewith whereby said sanding block will rotate on said pole mount, and said pole will rotate with said hub when cooperatively engaged therewith; and, said side edge providing a means to prevent marring of an adjacent surface intersecting a surface to be finished, whereby said side edge will contact said adjacent surface and roll thereon during said contact.

2. The improved sanding block of claim 1, additionally comprising a resilient bumper attached to said side edge.

3. The improved sanding block of claim 2, wherein said means for attachment of said second end of said hub to a pole comprises:

an elongated barrel engaged at a first end to said second end of said hub; and said elongated barrel configured at a second end, for cooperative engagement with said pole used in conjunction herewith.

4. The improved sanding block of claim 3 wherein said barrel is curved to a determined angle thereby causing angled engagement of said pole with said hub.

5. The improved sanding block of claim 1 wherein the pole used in combination herewith is curved at least one end.

6. The improved sanding block of claim 5, wherein said means for attachment of said second end of said hub to a pole comprises:

an elongated barrel engaged at a first end to said second end of said hub; and said elongated barrel configured at a second end, for cooperative engagement with said pole used in conjunction herewith.

7. The improved sanding block of claim 1, wherein said means for attachment of said second end of said hub to a pole comprises:

an elongated barrel engaged at a first end to said second end of said hub; and said elongated barrel configured at a second end, for cooperative engagement with said pole used in conjunction herewith.

8. The improved sanding block of claim 7 wherein said barrel is curved to a determined angle thereby causing angled engagement of said pole with said hub.

9. The improved sanding block of claim 7 additionally comprising means to minimize frictional engagement between said rear surface and said pole or said barrel.

10. The improved sanding block of claim 9 wherein said means to minimize frictional engagement between said rear surface and said pole comprise:

a substantially unobstructed surface between said pole mount and said rear edge; and a race adjacent to said rear edge.

11. The improved sanding block of claim 7 wherein said means to minimize frictional engagement between said rear surface and said pole or said barrel comprises:

a substantially flat surface on the exterior of said barrel.

12. The improved sanding block of claim 7 wherein said means to minimize frictional engagement between said rear surface and said pole or said barrel comprises:

a substantially flat surface on the exterior of said barrel; and a race adjacent to said rear edge.

13. The improved sanding block of claim 7, wherein said elongated barrel additionally comprises:

a first member configured for attachment to said hub;

a second member configured for attachment to said pole; and an adjustable knuckle connecting said first and second member, whereby said first member may be disposed at an angle to said second member.

14. The improved sanding block of claim 13 additionally comprising:

means to lock the rotational engagement of said pole mount to said rear surface, whereby rotation of said sanding block on said pole mount may be prevented.

15. The improved sanding block of claim 1 additionally comprising means to minimize frictional engagement between said rear surface and said pole.

16. The improved sanding block of claim 15 wherein said means to minimize frictional engagement between said rear surface and said pole comprise:

a substantially unobstructed surface between said pole mount and said rear edge; and a race adjacent to said rear edge.

17. The improved sanding block of claim 1 additionally comprising:

means to lock the rotational engagement of said pole mount to said rear surface, whereby rotation of said sanding block on said pole mount may be prevented.

* * * * *